United States Patent [19]

van Gennep

[11] 3,994,476

[45] Nov. 30, 1976

[54] AUTOMATIC BRAKING ARRANGEMENT FOR A WINDLASS

[76] Inventor: Jan van Gennep, 715 Laurel Ave., Menlo Park, Calif. 94025

[22] Filed: Mar. 20, 1975

[21] Appl. No.: 560,153

[52] U.S. Cl. ..... 254/186 R; 254/173 R; 188/134

[51] Int. Cl.[2] ..... B66D 1/00

[58] Field of Search..... 254/167, 168, 169, 173 R, 254/187 D, 187 G, 186 R; 188/134, 166, 82.9

[56] References Cited

UNITED STATES PATENTS

| | | | |
|---|---|---|---|
| 2,263,160 | 11/1941 | Brooks | 254/169 |
| 3,062,344 | 11/1962 | Kachinskas | 254/168 |
| 3,276,553 | 10/1966 | Tilloy | 188/134 |
| 3,433,332 | 3/1969 | Braun | 254/168 |

*Primary Examiner*—Robert J. Spar
*Assistant Examiner*—Kenneth Noland
*Attorney, Agent, or Firm*—C. Michael Zimmerman

[57] ABSTRACT

A hoist is described which includes a windlass for taking up and paying out a line which operates a block and tackle. The windlass is provided with a brake which is arranged to operate automatically to prevent unwanted paying out of the block and tackle line whenever a load is on the block and tackle. The brake operating mechanism includes a load sensing lever arm mounted for limited pivotal movement in response to a load being on the block and tackle, and linkage connecting such lever arm with a brake actuator for transmitting its motion to the actuator. The actuator is adapted to respond to such motion by applying the brake on the windlass to prevent its rotation in response to the force of the load.

14 Claims, 9 Drawing Figures

AUTOMATIC BRAKING ARRANGEMENT FOR A WINDLASS

BACKGROUND OF THE INVENTION

The present invention relates to hoists and the like and more particularly to an improved arrangement for automatically operating a brake on a windlass thereof to prevent unwanted reverse rotation of said windlass, such as when it is desired to maintain a load in an elevated or other position in opposition to the reverse rotational force applied to the windlass by such load.

Hoists are widely used to lift and support loads of various kinds. For example, hoists find wide usage in automobile garages and the like for lifting and supporting heavy automobile parts, e.g., engines. Most hoists are basically block and tackle arrangements, some of which simply require manual input of energy for operation, and others which are motor driven. It will be recognized that if a hoist is going to be used to support a load in an elevated position as well as to lift such load, means of one sort or another must be provided for assuring that the hoist does not allow the load to lower, except when desired. Because unwanted and unexpected lowering of a load might result in injury to personnel in the vicinity, safety alone requires such a braking arrangement.

Various types of such a braking arrangement have been provided in the past ranging from, for example, mechanical ratchet and pall stopping apparatuses in hand operated hoists to disc brake arrangements in motor driven hoists. The difficulty with such arrangements now available, however, is that in general they do not automatically operate in response to a load being applied to the windlass. In this connection, some require operation by an operator. Others, such as the disc brake arrangements found on motor driven hoists rely for actuation to lack of rotation of the windlass, rather than on whether or not there is a load on such windlass. Whichever kind, because they do not react automatically in response to a load being present on the hoist windlass, they have proven unreliable at times. Moreover, those arrangements which are the most reliable tend to be quite expensive.

SUMMARY OF THE INVENTION

The present invention provides a braking arrangement for automatically operating a brake on a windlass to prevent unwanted reverse rotation of such windlass. In its basic aspects, it includes load sensing means for indicating the presence on the windlass of any load tending to cause reverse rotation thereof, i.e., rotation in a direction responding to the force of the load. It further includes brake operating means responsive to the load sensing means indicating the presence of a load by applying the brake to prevent such reverse rotation, and means for rendering the brake operating means ineffective in response to sufficient force being applied to the windlass to rotate the same in a forward direction in opposition to the reverse rotational force applied by the load. Because of the presence of the load sensing means and the direct response of the brake operating means thereto, a user of a hoist or other windlass apparatus including the braking arrangement of the invention is assured that operation of the brake is dependent upon a condition which might be responsible for reverse rotation of the windlass, rather than some extraneous condition, such as the lack of rotation of the windlass.

Most desirably, the load sensing means is adapted to indicate the value of any load force tending to cause reverse rotation on the windlass, and the brake operating means is responsive to the value so indicated by applying the brake with a pressure directly proportional to the load force. Thus, the brake pressure is assured, within the structural limits of the mechanism, to be sufficient to overcome the load force, while yet being of a value dependent upon such load force so that a known amount of force can be applied to overcome the brake pressure for desired reverse rotation of the windlass. The force required to be applied for reverse rotation of the windlass can, therefore, be chosen to be proportional to the load just as the force required for forward rotation will be proportional to such load.

In the preferred embodiment, the above principles are embodied in a simple lever arm and linkage arrangement which operate a drum brake associated with the windlass. Such mechanical arrangement is applicable to both manual operated and motor driven windlasses and is equally effective with both. For a better understanding of the invention, as well as a description of other features and advantages thereof, reference is made to the following more detailed description of a preferred embodiment.

BRIEF DESCRIPTION OF THE DRAWING

With reference to the accompanying three sheets of drawing.

DETAILED DESCRIPTION OF THE PREFERRED EMBODIMENT

Figure 1:
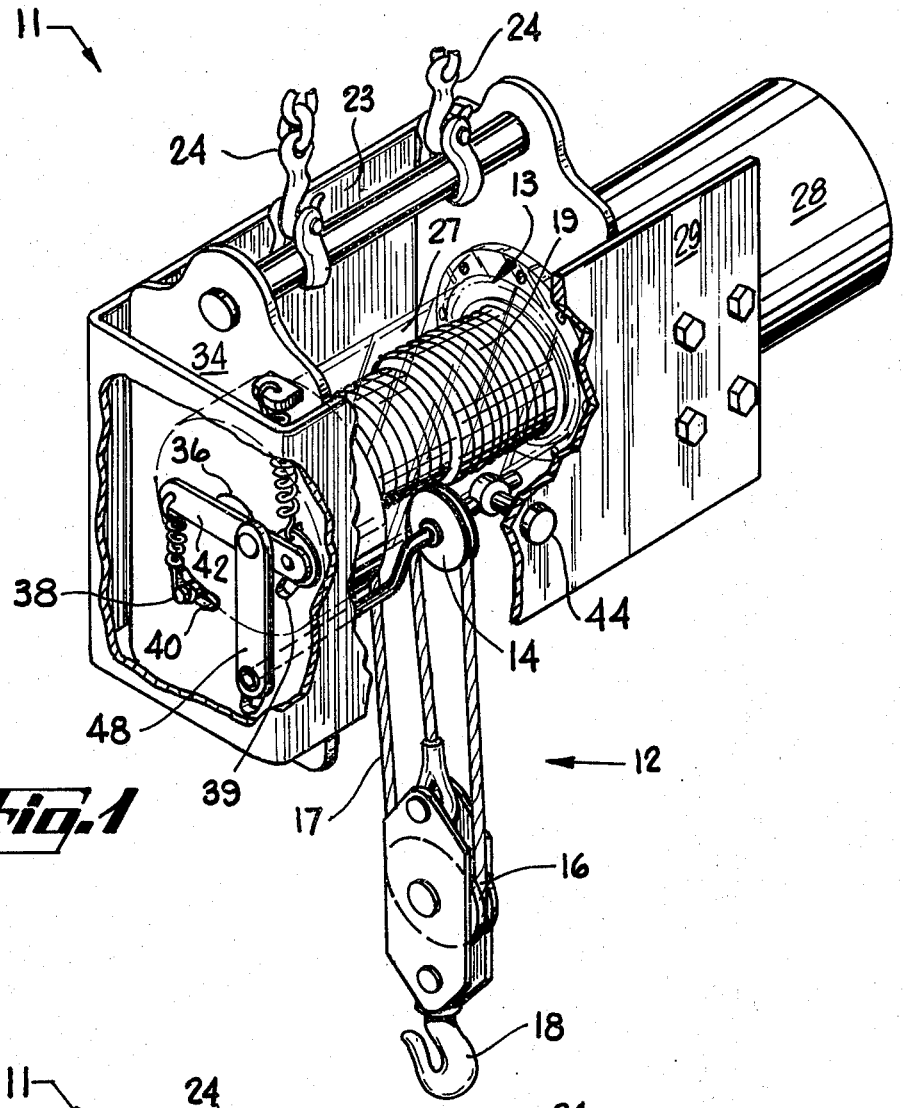
FIG. 1 is a perspective view of a preferred embodiment of the hoist incorporating the invention with portions of the housing thereof broken away to illustrate details of its construction.
Figure 2:
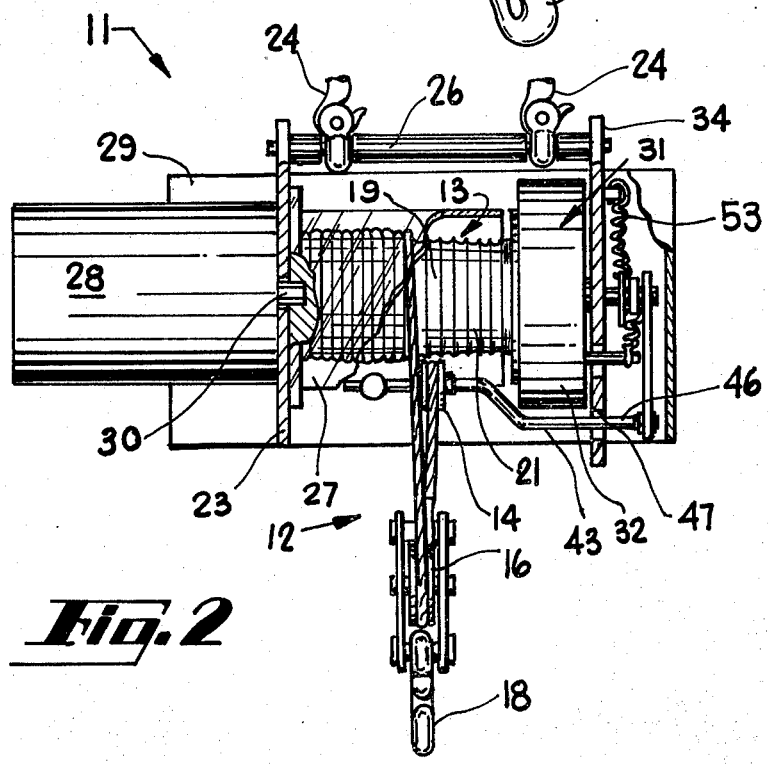
FIG. 2 is a side elevation of the hoist of FIG. 1 with portions of the housing again broken away to illustrate details.
Figure 3:
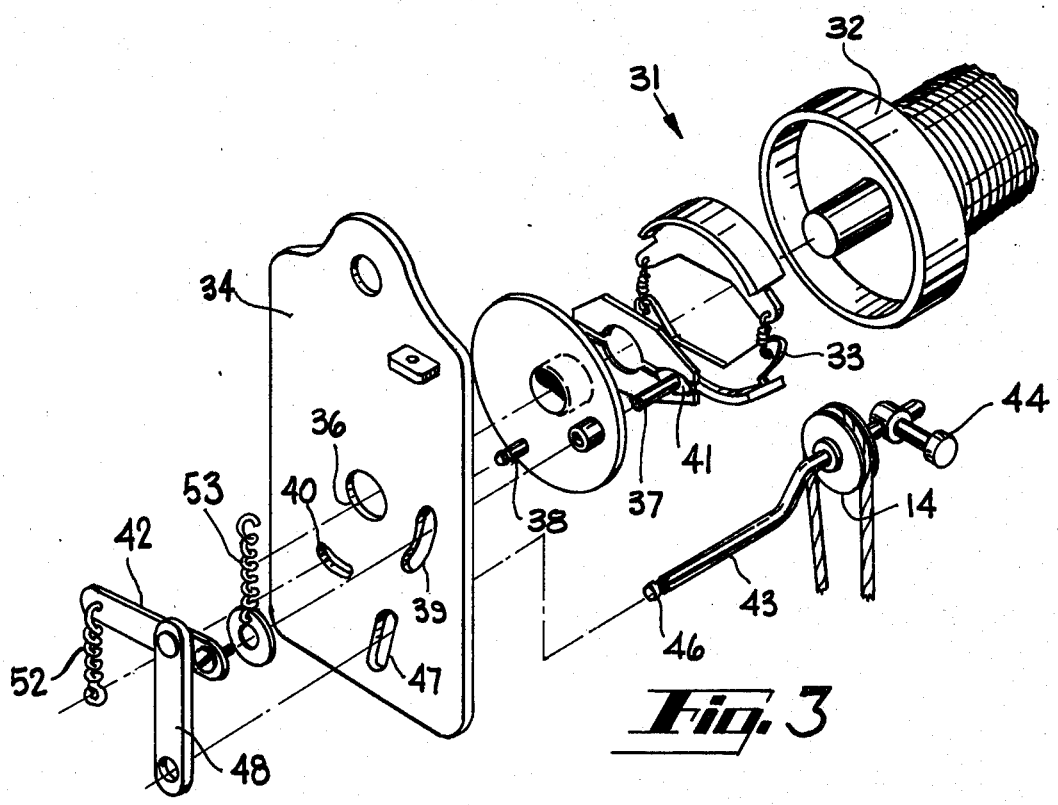
FIG. 3 is an exploded perspective view illustrating in more detail the relationships of the various components of the braking arrangement of the preferred embodiment; and FIGS. *4a–4b; 5a–5b;* and *6a–6b* are schematic drawings illustrating the operation of the braking arrangement of the preferred embodiment.

FIGS. 1–3 show a preferred embodment of a hoist, generally referred to by the reference numeral 11, incorporating the invention. Hoist 11 is basically a block and tackle 12 combined with a windlass 13 for taking up and paying out the block and tackle line. As illustrated, the block and tackle includes upper and lower pulleys 14 and 16, respectively, about which a line in the form of a cable 17 is threaded to provide the block and tackle with a mechanical advantage of 3. A hook 18 projects downwardly from the block of pulley 16 to act as means for securing a load thereto, and the free end of line 17 extends upwardly and is wrapped around a cable drum 19 of the windlass. As illustrated, the cable drum 19 is provided with a closely spaced spiral groove 21 for guiding the wrapping of the cable therearound. Although not shown, it will be recognized that the upper end of the cable 17 is firmly secured to the drum of the windlass to be rotated therewith.

The windlass 13 is mounted for rotation within a housing 23. As illustrated, such housing is adapted to be hung from an elevated structural member, for example, by a pair of hooks 24 which are mounted in spaced-apart relationship on a bar 26 which extends along the top of the housing generally parallel to the windlass. The double, spaced-apart securance provided by the hooks 24 is preferred for this embodiment in view of the lateral shifting along the drum of the location at which any load being raises is applied to the hoist as the cable 17 is wound about such drum. Housing 23 provides structural support for the windlass, as well as for the other components of the hoist. A cable guide shield 27 is provided to prevent the cable from being bunched at one location around the drum as it is wound, and guide it along the full face of such drum.

Means are also provided for selectively rotating the windlass in forward and reverse directions, directions respectively taking up and paying out the cable. That is, an electric motor 28 is mounted on a back plate 29 which projects from the housing 23. As best seen in FIG. 2, the shaft of the motor 28 engages a drive socket 30 at one end of the windlass.

A braking arrangement is provided for controlling reverse rotation of the windlass. As discussed previously, the braking arrangement of the invention responds automatically to the presence of a load on the windlass to prevent the windlass from being rotated reversely by the load. Such braking arrangement includes a conventional drum brake 31 which is mounted at one end of the windlass. As shown in FIG. 3, the drum 32 of such brake is rigidly associated with the windlass drum 19 for rotation therewith, whereas the brake shoe assembly 33 is associated with the housing 23. In this connection, the housing 23 includes an inner support plate 34 within which one end of the windlass 19 is journalled at 36 for rotation. The brake shoe components of the drum brake project inwardly from the support plate 34 into the interior of the drum whereat such shoes are engageable with the interior cylindrical surface of the brake drum to provide braking action. The brake shoe assembly is not rigidly secured to the support plate 34, but is sandwiched between such support plate and the front face of the brake drum. A pair of pins 37 and 38 project from such brake shoe assembly through corresponding slots 39 and 40 in the support plate to provide appropriate lateral placement of the brake shoe assembly relative to the drum, as well as to perform other functions as will be described.

From the above, it will be recognized that when the brake is applied, the brake shoes of the assembly 33 will engage the drum 32 to inhibit its and, hence, the windlass drum's rotation. The brake is applied by rotating the pin 37 to cause the cam 41 secured thereto to spread the brake shoes apart. A lever actuator 42 for rotating the pin 37 is mounted on such pin on the side of support plate 34 opposite the drum brake. Because of the shape of the cam 41, the amount of brake pressure obtained upon downward movement (counter-clockwise rotation) of the lever 42 will be directly dependent upon the distance of such movement and the value of the force tending to cause further movement of such actuator. Many commercially available drum brakes, such as the one sold by Bendix Corporation with the designation No. 315933 primarily for use on go-carts, are actuated in this manner.

As discussed previously, as a particularly salient feature of the instant invention, the braking arrangement is adapted to apply the brake in response to a load on the windlass tending to cause reverse rotation thereof. In this connection, load sensing means are provided for indicating the presence on the windlass of such a load. That is, a load sensing lever arm 43 has one end pivotally mounted at 44 to the housing 23, and the other end 46 thereof extending through a vertical slot 47 in the support plate 34 of such housing. As illustrated, the upper pulley 14 of the block and tackle is positioned on and supported by the load sensing arm 43. With this arrangement, it will be appreciated that any load supported by the block and tackle will apply a downward force on the arm 43 tending to pivot it downward about point 44. Moreover, the force so applied to the sensing arm will be directly proportional to the load force being supported by the block and tackle and, hence, proportional to the load force tending to rotate the windlass in a reverse direction.

Brake operating means are provided which are responsive to the lever 46 indicating the presence of a load on the windlass by applying the brake to prevent its reverse rotation. More particularly, a linkage link 48 connects the end 46 of the sensing lever to the actuator lever arm 42. As illustrated, the link 48 is connected to the arm 42 at a location at which it will rotate the arm in the counter-clockwise direction (FIGS. 1 and 2) upon being moved downward with the sensing arm by a load on the block and tackle and, hence, will apply the brake. The degree of brake application, i.e., the amount of applied brake pressure, will be proportional to the downward force provided by the weight of the load since the lever arm will be urged downwardly proportionate to such load force.

Figure 4A:
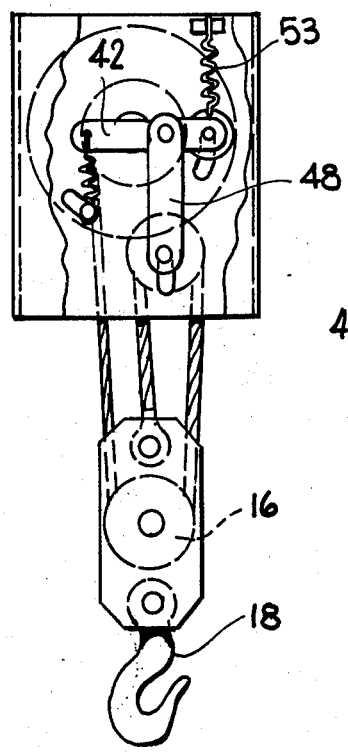
Figure 4B:
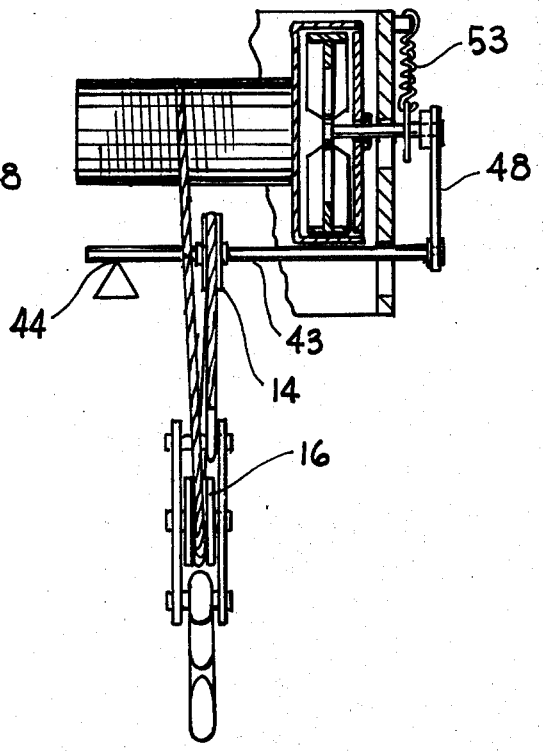
Figure 5A:
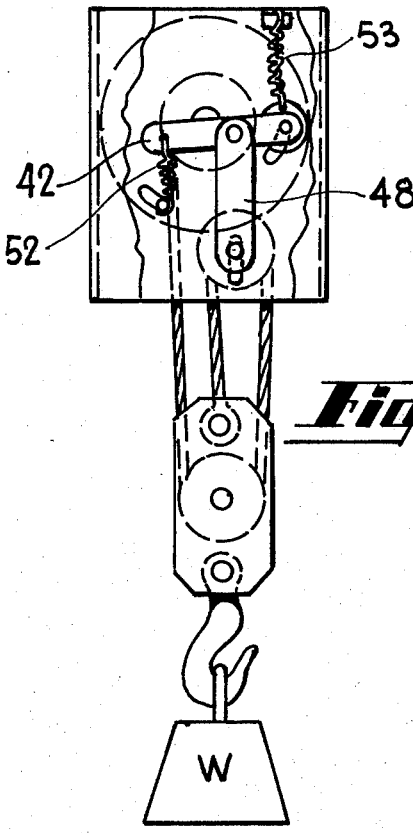
Figure 5B:
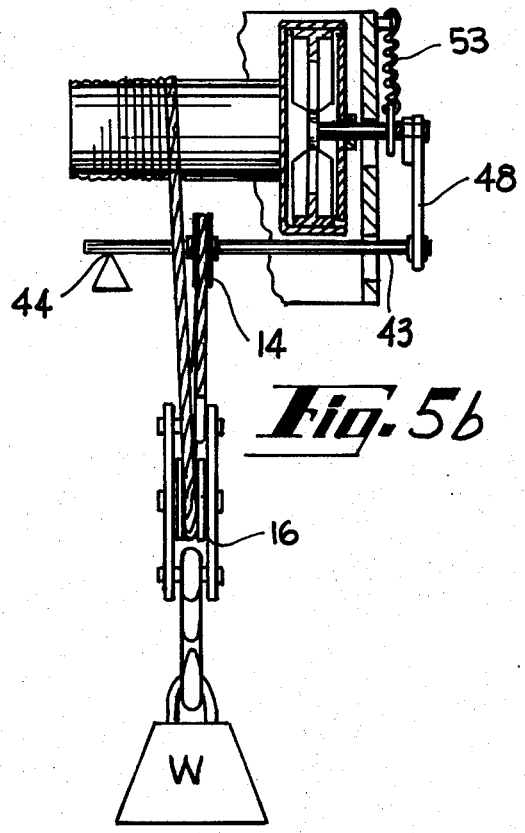
Figure 6A:
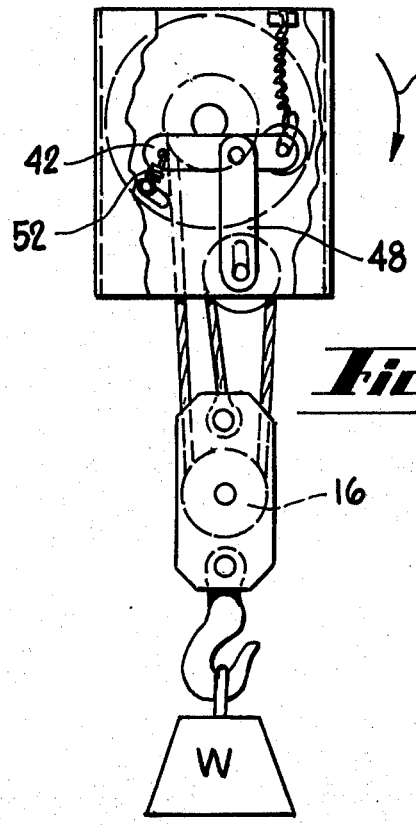
Figure 6:
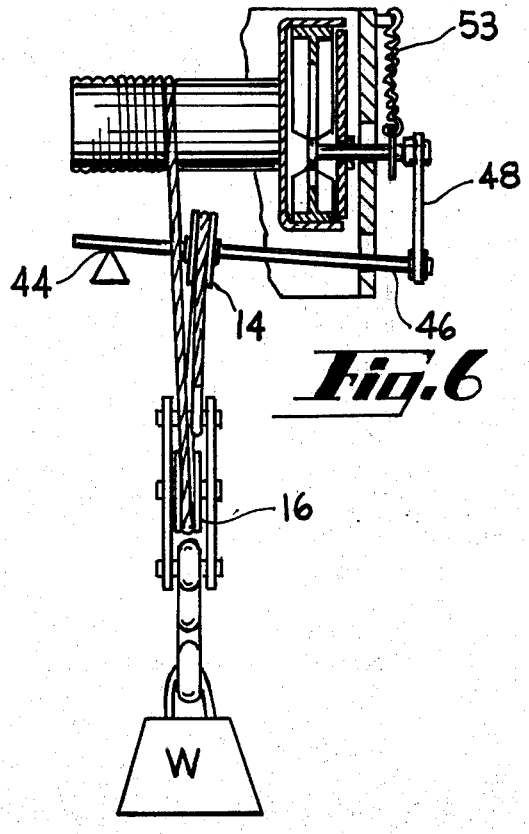

The schematic showings of FIGS. 4–6 have been included to facilitate an understanding of the operation of the braking mechanism. FIGS. **4*a* and 4*b* are, respectively, end and side elevational views of the operating mechanism when, for example, no weight or load has been applied to the windlass. As illustrated therein, the brake actuator 42 is in a generally horizontal position at such time with the result that the brake is disengaged. The windlass is thus free to rotate to allow line, for example, to be paid out therefrom by hand. However, when a load is applied to the block and tackle, such as when a weight is elevated, the brake operating mechanism applies the brake. FIGS. 5*a* and 5*b* illustrate the condition of the brake operating mechanism at such time. As illustrated in FIG. 5*b*, the application of the load to the pulley 14 will cause the lever sensing arm 43 to be pivoted downward about its pivotal mounting to the windlass housing as represented at 44. The result will be that the link 48 is correspondingly moved vertically downward and pivots the actuator 42 in the counter-clockwise direction, as viewed in FIGS. 4–6,** to apply the brake.

It will be apparent from FIG. 5 how the value of the downward force applied by the load will, by it being applied to the sensing lever 43, control the amount of brake pressure applied by the actuator 42. This proportional relationship will assure that the amount of brake pressure which is applied is sufficient to resist the load irrespective of the value of the load, subject, of course, to the structural limitations of the arrangement.

The braking arrangement of the invention also includes a quite simple mechanism for rendering the brake operating means ineffective whenever sufficient forward rotational force is applied to the windlass to rotate it forwardly to raise the load. That is, upon the motor, for example, providing such sufficient forward rotational force, the windlass, the brake drum rigidly secured thereto, and the brake shoe assembly 33 will be rotated in the forward direction, i.e., the direction of the arrow 51 in FIG. 6*a*. The rotation of the brake shoe assembly is permitted since it is not rigidly secured to the support plate 34. Upon such rotation of the brake shoe assembly, the pin 37 will move downward within the slot 39, causing a corresponding downward movement of the actuator 42 and link 48. The result will be that the end 46 of the lever sensing arm will engage the lower edge of the slot 47 as illustrated in FIG. 6*b*. Because of such engagement, the load sensing arm 43 and, hence, the link 48 will be prevented from further downward movement upon rotation of the brake shoe assembly. The result will be that as the brake shoe assembly continues to rotate when the motor turns the drum forwardly, the link 48 will maintain its point of connection with the actuator 42 stationary so that such actuator will be pivoted in the clockwise direction, as viewed in FIG. 6, relative to the brake shoe assembly upon such further rotation. Hence, the brake shoes will be disengaged from the brake drum. The release of the brake will allow further rotation of the windlass in the forward direction to take up the line 17 and, therefore, operate the block and tackle 12 to raise the load 18. The bottom end of the slot 47 thus acts as a stop on the housing which is engaged by the load sensing lever upon rotational movement of the windlass to cause the release of the brake upon any further rotation of such windlass. It should be noted that upon such further rotation, the bottom of the slot 47 will also support the load.

Whenever the force causing forward rotational force of the windlass is stopped, e.g., the motor 28 is turned off, the braking arrangement will automatically again become effective to prevent reverse rotation of the windlass and, hence, maintain the load in the elevated position. More particularly, it will be appreciated that upon such stopping, the force of the load on the windlass will tend to cause it to rotate in the reverse direction. Means are provided for initially operating the brake to inhibit such reverse rotation. To this end, a spring 52 is maintained in tension between the free end of the actuator arm 42 and the pin 38 secured to the brake shoe assembly. Such spring will thus apply a constant force to the actuator tending to rotate the same in the counter-clockwise direction, and, hence, apply the brake. Because of the resulting friction between the brake drum and the brake shoe assembly upon the windlass beginning to rotate in the reverse direction in response to a load when the motor 28 is turned off, the brake shoe assembly will follow the same in such direction, with the result that the pin 37 and the actuator arm attached thereto will move upward and, hence, move the link 48 and sensing arm 43 upward off of the stop provided by the bottom edge of the slot 47 to again bring the brake operating mechanism under the influence of the load force on the block and tackle. The result will be that the brake will be again applied as shown in FIGS. 5*a* and 5*b* by an amount proportional to such load force to prevent further reverse rotation of the windlass and thereby maintain the load in its elevated position. The spring 52 will cause the brake to be slightly applied at all times in the manner described and, therefore, provides a safety interlock for preventing run-aways.

A second spring 53 is connected in tension between the pin 37 and the housing so as to normally urge such pin upwardly in the slot 39. This second spring acts, in effect, as a backup spring for the spring 52.

When it is desired to lower the load, the motor 27 is reversed to apply a reverse rotational force to the windlass. Such force is chosen to be sufficient to overcome the resistance provided by the brake due to the load to such reverse rotation and, hence, cause the reverse rotation. Because during such time the brake will continue to be applied, reverse rotation will be prevented if at any time such additional reverse rotational force is stopped. Runaways are, therefore, automatically resisted. During such reverse rotation, the brake operating mechanism will maintain the relationships shown in FIGS. 5*a* and 5*b*.

The particular positions at which the various levers and links are coupled together relative to their lengths will, of course, determine the amount of brake pressure which will be applied in response to any particular load value. For safety purposes, the connection points should be chosen to provide more than enough brake pressure to resist reverse rotation of the windlass to any particular load. In one embodiment of the invention, they were selected to provide a brake pressure which would resist just twice the actual load force tending to cause reverse rotation of the windlass. With such a 2:1 ratio arrangement, it will be appreciated that the amount of force which must be applied to the windlass to cause reverse rotation against such pressure is the same amount of force required to rotate the windlass in the forward direction to raise the load. That is, the linkages were chosen so that if, for example, the line 17 provides a 20 pound load force tending to cause the windlass to rotate reversely, the pressure applied by the brake would be sufficient to barely overcome a 40 pound load, twice the value of the load. Then the amount of reverse rotational force which must be applied to the windlass to cause it to rotate against the brake pressure equals that sufficient to overcome the additional 20 pound force provided by the brake. Thus, the amount of rotational force required to overcome a 20 pound load force must be applied to the windlass irrespective of the particular direction in which the windlass is to be rotated to move the load.

Although this preferred embodiment of the invention has been described in combination with a motor for causing rotation of the windlass, it will be appreciated that the principles of the invention are also applicable to manually operated windlasses. In this connection, the motor in the preferred embodiment is, it will be recognized, easily detachable so that other means, such as a ratchet handle, can be used by an operator to cause windlass rotation. The 2:1 brake pressure-force ratio discussed above is especially desirable in a hand operated hoist. With such, the force to be applied manually by the operator to the windlass to rotate the same will be the same for both forward and reverse rotation. Thus, the "feel" provided by the hoist in response to any load will be directly dependent upon the value of such load irrespective of the direction of hoist movement.

Although the invention has been described in connection with a preferred embodiment, it will be appreciated by those skilled in the art that various changes and modifications can be made without departing from its spirit. For example, while as described, it is the load sensing lever which engages the stop (the bottom of the slot 47) to render the brake ineffective upon forward rotational force being applied to the windlass, a stop could easily be placed in another position to engage any other moving part of the brake operating mechanism to achieve the same result. Moreover, the principles of the invention are not limited to hoists, but are also applicable to other hoist-like apparatuses, e.g., winches, which include a windlass. The term "windlass" in the broadest sense used here is meant to include any shaft subject to a reverse rotational force, e.g., reverse torque on a motor shaft. It is, therefore, intended that the coverage afforded applicant be limited only by the language of the claims and its equivalent.

What is claimed is:

1. A braking arrangement for automatically operating a brake on a windlass to prevent unwanted reverse rotation of said windlass, comprising load sensing means for indicating the presence on said windlass of any load tending to cause rotation thereof in the reverse direction irrespective of said windless rotating in either a forward or reverse direction, frictional brake means for controlling rotation of said windlass, brake operating means automatically responsive to said load sensing means indicating the presence of any such load on said windlass by applying said frictional brake to prevent said reverse rotation, means for applying against the pressure of said brake sufficient reverse rotational force to said windlass to overcome the resistance of said brake pressure to reverse rotation, and means for rendering said brake operating means substantially ineffective in response to sufficient forward rotational force being applied to said windlass to rotate the same in a forward direction in opposition to the reverse rotational force applied by said load.

2. The braking arrangement of claim 1 further including means for initially operating said brake to inhibit reverse rotation of said windlass immediately after the release from said windlass of said sufficient forward rotational force causing the same to rotate in a forward direction in opposition to the reverse rotational force applied by said load.

3. The braking arrangement of claim 1 wherein said load sensing means is adapted to indicate the value of any load force tending to cause reverse rotation of said windlass, and said brake operating means is adapted to be responsive to said value of said force by applying said brake with a pressure directly proportional to said load force.

4. The braking arrangement of claim 1 wherein said brake includes an actuator whose distance of movement is proportional to the pressure it causes said brake to apply to said windlass to prevent said reverse rotation thereof, said load sensing means is a lever arm to which said load is applied and which is mounted for movement upon application of such a load through a distance proportional to the reverse rotational force provided by said load, and said brake operating means responsive to said load sensing means includes linkage connecting said load sensing lever to said brake actuator for transmitting the motion of said load sensing lever to said actuator to thereby apply said brake with a pressure directly proportional to said load force.

5. The braking arrangement of claim 4 further including spring means connected with said brake actuator for initially operating said brake to inhibit reverse rotation of said windlass immediately after the release from said windlass of said sufficient forward rotational force causing the same to rotate in a forward direction in opposition to the reverse rotational force applied by said load.

6. The braking arrangement of claim 4 wherein at least one of said load sensing lever, linkage and actuator is mounted for movement with said windlass whenever said brake is applied during forward rotational movement of said windlass, and said means for rendering said brake operating means ineffective includes a stop against which said one of said load sensing lever, said linkage, and said actuator is engaged upon said forward rotational movement of said windlass to cause said brake actuator to release said brake upon further rotation of said windlass.

7. The braking arrangement of claim 6 wherein said windlass is mounted within a housing which remains stationary with respect thereto upon windlass rotation, and said stop is provided on said housing for engagement by said one of said load sensing lever, said linkage and actuator upon said forward rotation of said windlass.

8. The braking arrangement of claim 6 further including means for rotating said windlass in the reverse direction with a sufficient rotational force to overcome the resistance of said brake pressure to reverse rotation.

9. A hoist or the like comprising a windlass which is selectively rotatable in forward and reverse directions respectively to take in or pay out a line to which a load to be moved is securable; a housing for said windlass which remains stationary with respect thereto upon rotation of said windlass; and a brake arrangement for automatically operating a frictional brake on said windlass to prevent unwanted reverse rotation of the same in response to a load tending to cause such reverse rotation comprising load sensing means to which said load is applied and which is mounted on said housing for movement upon any load tending to cause such reverse rotation being applied thereto irrespective of said windless rotating in either a forward or reverse direction, a lever arm actuator for said brake, linkage connecting said load sensing means to said brake actuator for transmitting the motion of said load sensing means to said actuator to apply said frictional brake to prevent reverse rotation of said windlass, and means for applying against the pressure of said frictional brake sufficient reverse rotational force to said windlass to overcome the resistance of said brake pressure to reverse rotation.

10. The hoist or the like of claim 9 wherein said brake is a drum brake with the drum thereof associated with one of said windlass and housing, and the brake shoes thereof associated with the other of said windlass and housing.

11. The hoist or the like of claim 9 wherein said brake actuator is adapted to cause said brake pressure applied to said windlass to prevent said reverse rotation thereof to be directly proportional to the distance of movement of said actuator, said load sensing means is a lever pivotally mounted on said housing for movement upon application of such a load thereto through a distance proportionai to the reverse rotational force provided on said windlass by said load, and said linkage is connected between said load sensing lever and said actuator to cause movement of said brake actuator through a distance proportional to the distance of movement of said load sensing lever, whereby said brake is applied with a pressure directly proportional to said load force.

12. The hoist or the like of claim 11 wherein means are provided for adjusting the location along said load sensing lever at which said load is applied thereto relative to its pivot point on said housing to correspondingly adjust the distance said lever arm moves in response to any specific load and thereby correspondingly vary the brake pressure which is applied in opposition to the reverse rotational force caused on said windlass by said load.

13. The hoist or the like of claim 12 further including a block and tackle having a mechanical advantage greater than one connected between said load sensing lever and means for direct securance to a load, the location at which said block and tackle is connected with said load sensing lever being adjustable to provide said adjustment of the distance through which said load sensing lever moves.

14. The hoist or the like of claim 13 further including a motor for selectively rotating said windlass in said forward and reverse directions.

* * * * *